US005090309A

United States Patent [19]

Lai

[11] Patent Number: 5,090,309

[45] Date of Patent: Feb. 25, 1992

[54] WASTE CONTAINER

[76] Inventor: Fu-Tung Lai, No. 1, Lane 140, Sec. 1, Hsi-Tun Rd., Taichung City, Taiwan

[21] Appl. No.: 682,612

[22] Filed: Apr. 9, 1991

[51] Int. Cl.[5] ..... B30B 1/00; B30B 15/06

[52] U.S. Cl. ..... 100/226; 53/527; 100/246; 100/295; 220/908

[58] Field of Search ..... 100/226, 240, 245-247, 100/295; 141/73; 220/908; 53/527

[56] References Cited

U.S. PATENT DOCUMENTS

| | | | |
|---|---|---|---|
| 132,486 | 10/1872 | Pagett et al. | 100/245 |
| 1,944,904 | 1/1934 | Read | 100/226 X |
| 3,565,351 | 2/1971 | Ross, Jr. | 100/240 X |
| 3,760,718 | 9/1973 | Adornetto | 141/73 X |
| 3,779,157 | 12/1973 | Ross, Jr. et al. | 100/240 |
| 3,946,662 | 3/1976 | Ross, Jr. et al. | 100/240 |
| 4,658,720 | 4/1987 | Massonnet | 100/226 |

*Primary Examiner*—Harvey C. Hornsby
*Assistant Examiner*—Stephen F. Gerrity

[57] ABSTRACT

A waste container includes a hollow body having an open top end, a cover detachably provided on the open top end, and a press member movably mounted on the cover and having a plate portion disposed horizontally inside the hollow body. The press member is vertically movable inside the hollow body to compress garbage inside the hollow body.

5 Claims, 4 Drawing Sheets

WASTE CONTAINER

BACKGROUND OF THE INVENTION

1. Field of the Invention

The invention relates to waste containers, more particularly to a waste container having provisions to compress garbage contained therein.

2. Description of the Related Art

There are, at present, a wide variety of waste containers available to the consumers. One such waste container incorporates a cover which is lifted by operating a pedal device. Another type of waste container incorporates means for easily replacing a waste bag provided in the waste container.

A waste container is easily filled up since garbage, especially cartons, occupy a lot of space when thrown away in their original shapes and sizes. Garbage inside the waste container must be compressed to permit accommodation of more garbage. Presently, compression of garbage is done manually, either by hand or foot. Such a procedure is unsanitary and is, in most cases, distasteful.

SUMMARY OF THE INVENTION

Therefore, the main objective of the present invention is to provide a waste container having provisions to compress garbage contained therein.

Accordingly, the preferred embodiment of a waste container of the present invention comprises: a hollow body having an open top end; a cover detachably provided on the open top end and having a through hole and an inner side provided with a plurality of inwardly curving claw projections disposed around the through hole; and a press member movably mounted on the cover and having a plate portion horizontally disposed inside the hollow body, a post portion projecting upward from the plate portion and extending through the through hole, a first ball portion being axially mounted on the post portion and removably engaging the claw projections, and a second ball portion being axially mounted on a distal end of the post portion adjacent to the first ball portion. A tubular rod is disposed on an outer side of the cover and has an open end, an axially extending slot provided along the full length of the tubular rod, and a blocking plate covering the open end and having a notch communicated with the slot. The second ball portion is retained inside the tubular rod, while the post portion slidably extends into the slot. The tubular rod is rotatable from a first position, wherein the axis of the tubular rod is parallel to the cover, to a second position, wherein the axis of the tubular rod is transverse to the cover. The diameter of the tubular rod should be smaller than that of the through hole.

The tubular rod is pulled outward to abut the second ball portion with the blocking plate prior to rotation of the tubular rod from the first position to the second position. The tubular rod is then pushed downward to disengage the first ball portion from the claw projections and move the plate portion downward to compress garbage inside the hollow body. The tubular rod is pulled upward to engage the first ball portion and the claw projections.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
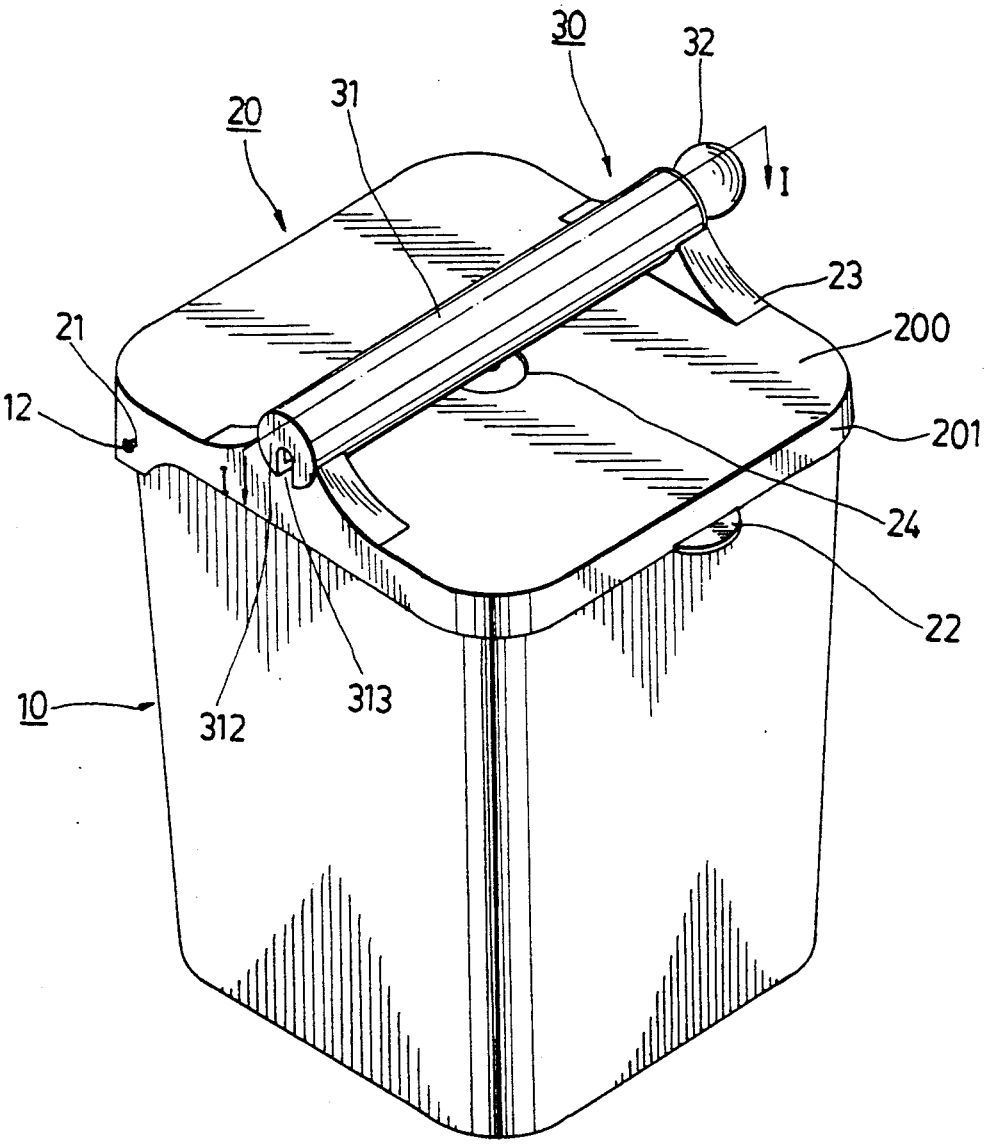
FIG. 1 is a perspective view of the preferred embodiment of an assembled waste container according to the present invention.
Figure 2:
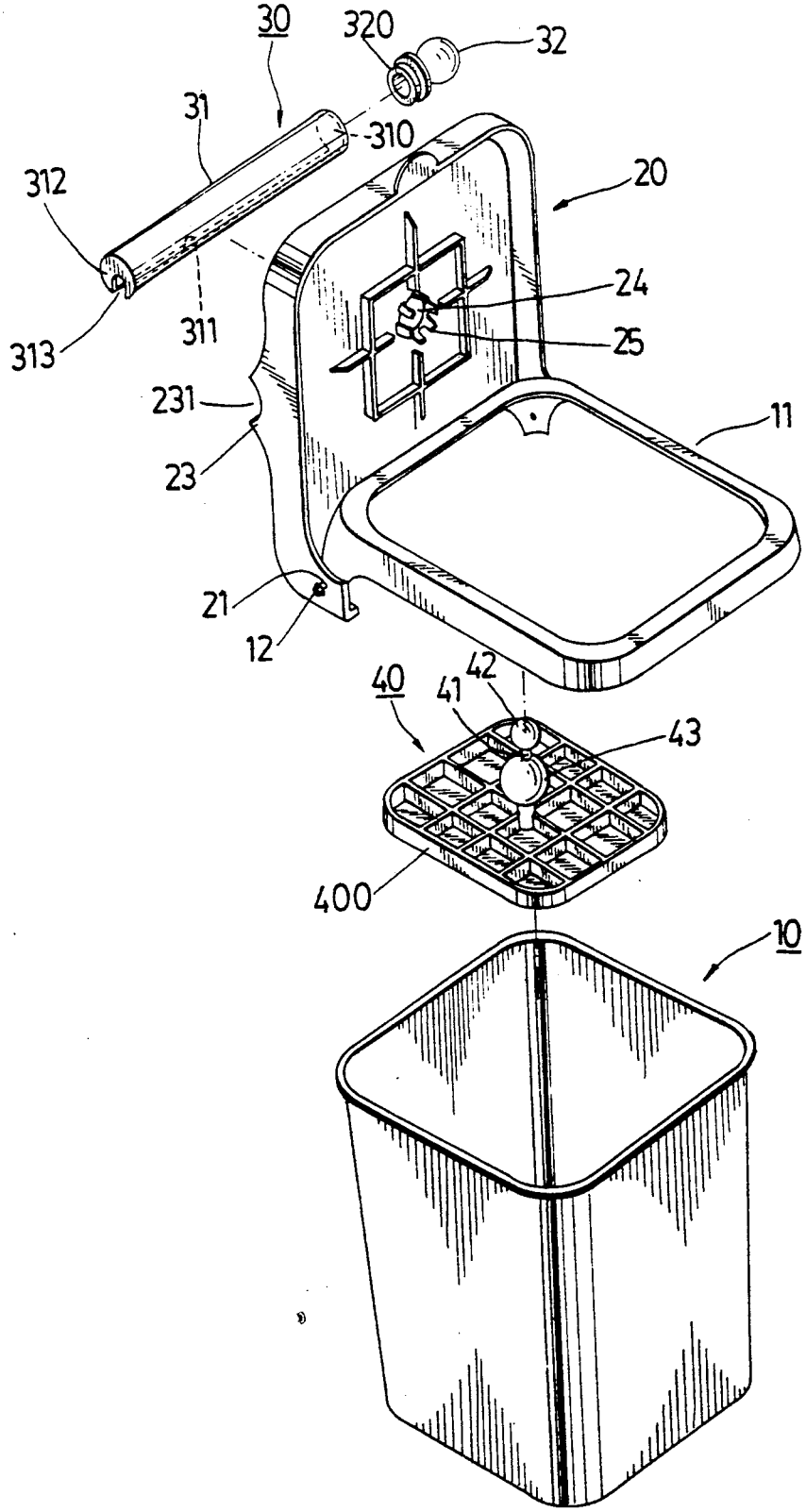
FIG. 2 is an exploded view of the waste container of the present invention.

Referring to FIGS. 1 and 2, the preferred embodiment of a waste container according to the present invention is shown to comprise a hollow body 10, a cover 20, a tubular rod 30, and a press member 40.

The hollow body 10 is generally rectangular in cross section. A rectangular loop frame 11 is detachably provided on an open top end of the hollow body 10. The loop frame 11 has a pair of outwardly extending hinge posts 12 disposed on opposite sides of the loop frame 11 and adjacent to the rear side thereof.

The cover 20 includes a plate 200 and a peripheral flange 201 extending rearward from the periphery of the plate 200. The peripheral flange 201 is provided with a pair of through holes 21 to receive the hinge posts 12. The cover 20 is thus turnable relative to the hollow body 10 between the closed position shown in FIG. 1 and the open position shown in FIG. 2. The peripheral flange 201 is further provided with an outward handle projection 22 to facilitate lifting the cover 20. The plate 200 has a through hole 24, and a pair of rod support projections 23 extending from an outer side of the plate 200 and disposed on opposite sides of the through hole 24. Each of the rod support projections 23 has a concave portion 231 formed on a top side thereof. The plate 200 further has an inner side provided with a plurality of inwardly curving claw projections 24 disposed around the through hole 24 (FIG. 2 shows the preferred embodiment to have six claw projections 24).

The tubular rod 30 comprises a tubular body 31, made of plastic, and having an open end 310, an axially extending slot 311 provided along the full length of the tubular body 31 at the bottom side thereof, and a blocking plate 312 disposed on the other end of the tubular body 31. The blocking plate 312 has a notch 313 communicated with the slot 311. A substantially ballshaped handle plug 32 has one end 320 detachably fitted into the open end 310 of the tubular body 31. The diameter of the tubular body 31 is smaller than that of the through hole 24.

The press piece 40 comprises a rectangular plate portion 400, a post portion 41 extending upward from the center of the plate portion 400, and two spaced ball portions, 42 and 43, mounted axially on the post 41.

Figure 3:
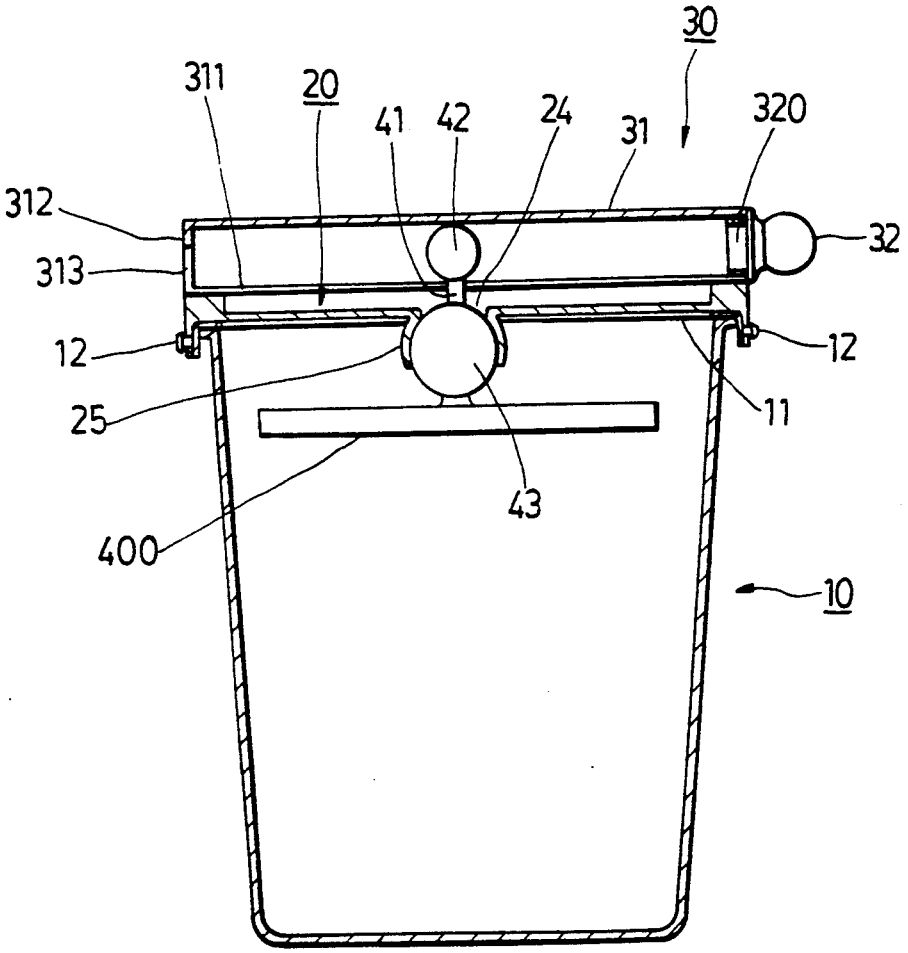
FIG. 3 is a sectional view of the waste container when in a static position of use.

Assembly of the preferred embodiment is as follows: Referring to FIGS. 2 and 3, the plate portion 400 is disposed horizontally inside the hollow body 10. The ball portion 43 engages the claw projections 25 to retain the plate portion 400 in a static position. The post portion 41 extends through the through hole 24 of the cover 20 so that the ball portion 42 is disposed above the cover 20. The tubular rod 30 then engages the press piece 40 such that the ball portion 42 is retained midway inside the tubular body 31 and the post portion 41 is slidably received by the slot 311. The handle plug 32 is then fitted into the open end 310 of the tubular body 31. Note that the axis of the tubular body 31 is parallel to the cover 20 when the press piece 40 is in the static position, and the two ends of the tubular body 31 are supported on the concave portions 231 of the rod support projections 23 on the cover 20.

Figure 4:
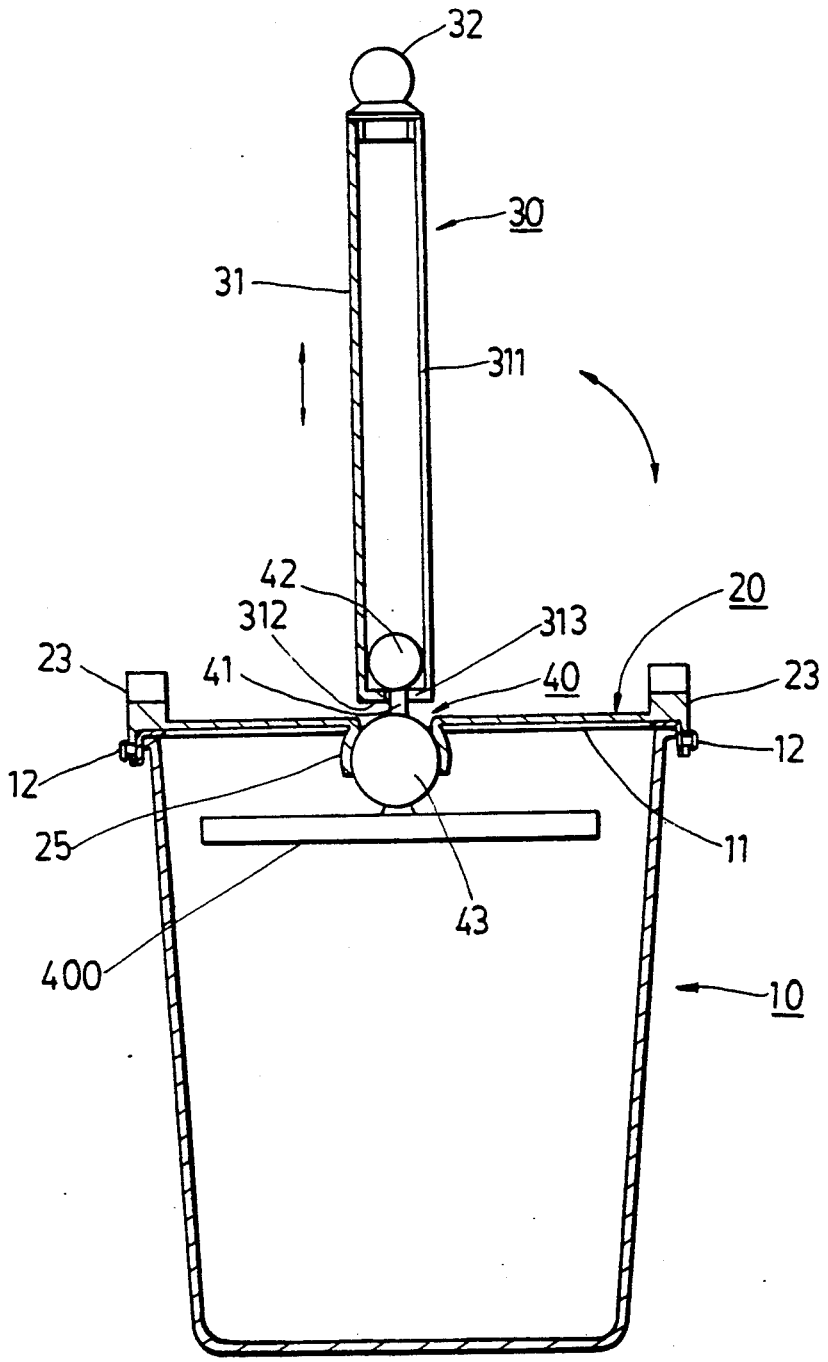
FIG. 4 is a sectional view of the preferred embodiment when in a position for compressing garbage contained therein.

The tubular rod 30 is rotatable from the static position shown in FIG. 3, to a compressing position, wherein the axis of the tubular rod 30 is transverse to the cover 20, as shown in FIG. 4.

Referring to FIG. 4, when compressing garbage contained inside the hollow body 10, the tubular rod 30 is pulled outward so that the blocking plate 312 abuts the ball portion 42. The tubular rod 30, which is pivoted on the ball portion 42, is then rotated upward from the static horizontal position to the compressing position, and is pushed downward so that the ball portion 43 disengages from the claw projections 25 and the plate portion 400 is forced downward to compress garbage inside the hollow body 10.

To return the press piece 40 to the static position, the tubular rod 30 is pulled upward so that the ball portion 43 engages the claw projections 25. The tubular rod 30 is then replaced in its former position on the rod support projections 23.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A waste container, comprising:

a hollow body having an open top end;

a cover detachably provided on said open top end;

a press member movably mounted on said cover and having a plate portion disposed horizontally inside said hollow body, said press member being vertically movable inside said hollow body to compress garbage inside said hollow body;

said cover has a through hole and an inner side provided with a plurality of inwardly curving claw projections disposed around said through hole; and said press member has a post portion projecting upward from said plate portion and extending through said through hole, and a first ball portion being axially mounted on said post portion and removably engaging said claw projections;

whereby, said press member is pushed downward to disengage said first ball portion from said claw projections and move said plate portion downward to compress garbage inside said hollow body.

2. The waste container as claimed in claim 1, wherein:

said press member further has a second ball portion axially mounted on a distal end of said post portion adjacent to said first ball portion; and said waste container further comprises a tubular rod disposed on an outer side of said cover and having a first open end, an axially extending slot provided along the full length of said tubular rod, and a blocking plate covering said first open end and having a notch communicated with said slot, said second ball portion being retained inside said tubular rod, said post portion slidably extending into said slot, said tubular rod being rotatable from a first position, wherein the axis of said tubular rod is parallel to said cover, to a second position, wherein the axis of said tubular rod is transverse to said cover, said tubular rod having a diameter smaller than that of said through hole;

whereby, said tubular rod is pulled outward until said second ball portion abuts said blocking plate, said tubular rod is then rotated from said first position to said second position, said post portion extends into said notch when said tubular rod is in said second position, said tubular rod is pushed downward to disengage said first ball portion from said claw projections, and said tubular rod is pulled upward to engage said first ball portion and said claw projections when said tubular rod is in said second position.

3. The waste container as claimed in claim 2, wherein said first ball portion has a diameter wider than that of said through hole.

4. The waste container as claimed in claim 2, wherein said tubular rod has a second open end, said waste container further comprises a handle plug detachably fitted into said second open end.

5. The waste container as claimed in claim 2, wherein said outer side of said cover is provided with a pair of rod support projections disposed on opposite sides of said through hole, each of said support projections having a concave portion formed on a top side thereof to receive a portion of said tubular rod.

* * * * *